United States Patent [19]

Davis et al.

[11] 4,195,052

[45] Mar. 25, 1980

[54] PRODUCTION OF IMPROVED POLYESTER FILAMENTS OF HIGH STRENGTH POSSESSING AN UNUSUALLY STABLE INTERNAL STRUCTURE

[75] Inventors: Herbert L. Davis, Convent Station; Michael L. Jaffe, Summit, both of N.J.; Herman L. LaNieve, III; Edward J. Powers, both of Charlotte, N.C.

[73] Assignee: Celanese Corporation, New York, N.Y.

[21] Appl. No.: 735,849

[22] Filed: Oct. 26, 1976

[51] Int. Cl.[2] ..... D01D 5/12

[52] U.S. Cl. ..... 264/210.5; 264/176 F; 264/235; 264/289.3

[58] Field of Search ..... 264/210 F, 235, 176 F, 264/290 T

[56] References Cited

U.S. PATENT DOCUMENTS

| | | | |
|---|---|---|---|
| 3,361,859 | 1/1968 | Cenzato | 264/176 F |
| 3,651,198 | 3/1972 | Mitsuishi et al. | 264/235 |
| 3,715,421 | 2/1973 | Marten et al. | 264/210 F |
| 3,752,457 | 8/1973 | Parmeggiani et al. | 264/210 F |
| 3,798,298 | 3/1974 | Krimpen et al. | 264/210 F |
| 3,838,561 | 10/1974 | Munting | 264/290 T |
| 3,946,100 | 3/1976 | Davis et al. | 264/176 F |
| 3,949,041 | 4/1976 | Schwarz | 264/210 F |
| 3,975,488 | 8/1976 | Patterson | 264/210 F |
| 3,977,175 | 8/1976 | Yoshikawa et al. | 264/210 F |
| 3,979,496 | 9/1976 | Schwarz | 264/210 F |
| 3,987,136 | 10/1976 | Schippers | 264/210 F |
| 4,000,239 | 12/1976 | Hamana et al. | 264/210 F |
| 4,003,974 | 1/1977 | Chantry et al. | 264/210 F |
| 4,019,311 | 4/1977 | Schippers | 264/210 F |
| 4,113,821 | 9/1978 | Russell et al. | 264/210 F |

FOREIGN PATENT DOCUMENTS

| | | | |
|---|---|---|---|
| 2117659 | 10/1971 | Fed. Rep. of Germany | 264/210 F |
| 2248342 | 5/1975 | France . | |
| 50-71924 | 6/1975 | Japan | 264/210 F |
| 50-88331 | 7/1975 | Japan | 264/210 F |
| 51-7215 | 1/1976 | Japan | 264/210 F |
| 51-53019 | 5/1976 | Japan | 264/210 F |
| 51-58522 | 5/1976 | Japan | 264/210 F |
| 947407 | 1/1964 | United Kingdom . | |
| 1006136 | 9/1965 | United Kingdom . | |
| 1343628 | 1/1974 | United Kingdom . | |
| 1385804 | 2/1975 | United Kingdom . | |

*Primary Examiner*—Jay H. Woo

*Attorney, Agent, or Firm*—Kenneth A. Genoni

[57] ABSTRACT

An improved process is provided for the formation of a high performance polyester (at least 85 mol percent polyethylene terephthalate) multifilament yarn. The product possesses a high strength (at least 7.5 grams per denier) and an unusually stable internal structure which renders it particularly suited for use in industrial applications at elevated temperatures. The filaments are melt spun and uniformly quenched under relatively high stress conditions (as described) to yield an as-spun filamentary material of relatively high birefringence ($+9\times10^{-3}$ to $+70\times10^{-3}$) which is passed in-line from the quench zone to a first draw zone where it is drawn at a draw ratio of 1.01:1 to 3.0:1, and subsequently is drawn (as described) to achieve at least 85 percent of the maximum draw ratio of the as-spun filamentary material. The resulting filamentary material exhibits unusually low shrinkage and hysteresis characteristics (i.e. work loss characteristics) as well as the high strength chatracteristics. Accordingly, when utilized in the formation of a tire cord and embedded in a rubber matrix a highly stable tire may be formed which exhibits a significantly lesser heat generation upon flexing.

29 Claims, 5 Drawing Figures

1
2
4
6
8
12
14
16
18
20
22
24
26
28
30
32
34
36
38
40
82
84
86
88
90
92
94
96
98

FORCE (POUNDS)
1.50
1.25
1.00
.75
.50
.25
0.2
0.4
0.6
0.8
DISPLACEMENT (INCHES)

FORCE (POUNDS)
1.50
1.25
1.00
.75
.50
.25
0.2
0.4
0.6
0.8
DISPLACEMENT (INCHES)

PRODUCTION OF IMPROVED POLYESTER FILAMENTS OF HIGH STRENGTH POSSESSING AN UNUSUALLY STABLE INTERNAL STRUCTURE

BACKGROUND OF THE INVENTION

Polyethylene terephthalate filaments of high strength are well known in the art and commonly are utilized in industrial applications. These may be differentiated from the usual textile polyester fibers by the higher levels of their tenacity and modulus characteristics, and often by a higher denier per filament. For instance, industrial polyester fibers commonly possess a tenacity of at least 7.5 (e.g. 8+) grams per denier and a denier per filament of about 3 to 15, while textile polyester fibers commonly possess a tenacity of about 3.5 to 4.5 grams per denier and a denier per filament of about 1 to 2. Commonly industrial polyester fibers are utilized in the formation of tire cord, conveyor belts, seat belts, V-belts, hosing, sewing thread, carpets, etc.

When polyethylene terephthalate is utilized as the starting material, a polymer having an intrinsic viscosity (I.V.) of about 0.6 to 0.7 deciliters per gram commonly is selected when forming textile fibers and a polymer having an intrinsic viscosity of about 0.7 to 1.0 deciliters per gram commonly is selected when forming industrial fibers. Both high stress and low stress spinning processes heretofore have been utilized during the formation of polyester fibers. Representative spinning processes proposed in the prior art which utilize higher than usual stress on the spin line include those of U.S. Pat. Nos. 2,604,667; 2,604,689; 3,946,100; and British Pat. No. 1,375,151. However, polyester fibers heretofore more commonly have been formed through the utilization of relatively low stress spinning conditions to yield a filamentary material of relatively low birefringence (i.e. below about $+2\times10^{-3}$) which particularly is amenable to extensive hot drawing whereby the required tenacity values ultimately are developed. Such as-spun polyester fibers commonly are subjected to subsequent hot drawing which may or may not be carried out in-line when forming textile as well as industrial fibers in order to develop the required tensile properties.

Heretofore high strength polyethylene terephthalate fibers (e.g. of at least 7.5 grams per denier) commonly undergo substantial shrinkage (e.g. at least 10 percent) when heated. Also heretofore, when such polyester industrial fibers are incorporated in a rubber matrix of a tire, it has been recognized that as the tire rotates during use the fibers are sequentially stretched and relaxed to a minute degree during each tire revolution. More specifically, the internal air pressure stresses the fibrous reinforcement of the tire, and tire rotation while axially loaded causes repeated stress variations. Since more energy is consumed during the stretching of the fibers than is recovered during the relaxation of the same, the difference in energy is dissipated as heat and can be termed hysteresis or work loss. Therefore, significant temperature increases have been observed in rotating tires during use which are attributable at least in part to this fiber hysteresis effect. Lower rates of heat generation in tires will lower tire operating temperatures, maintain higher modulus values in the reinforcing fiber, and extend the life of the same through the minimization of degradation in the reinforcing fiber and in the rubber matrix. The effect of lower hysteresis rubbers has been recognized. See, for instance *Rubber Chem. Technol.*, 45, 1, by P. Kainradl and G. Kaufmann (1972). However, little has been published on hysteresis differences in reinforcing fibers and particularly hysteresis differences between various polyester fibers. See, for instance, U.S. Pat. No. 3,553,307 to F. J. Kovac and G. W. Rye.

In our U.S. Ser. No. 735,850, filed concurrently herewith (now U.S. Pat. No. 4,101,525, granted July 18, 1978). entitled "Improved Polyester Yarn of High Strength Possessing an Unusually Stable Internal Structure" is claimed a yarn product which may be produced by the process of the present invention.

It is an object of the present invention to provide an improved process for the production of high performance polyester fibers of high strength which particularly are suited for use in industrial applications.

It is an object of the present invention to provide an improved process for the production of polyester fibers possessing an unusually stable internal structure.

It is an object of the present invention to provide a process for the production of high strength polyester industrial fibers which exhibit unusually low shrinkage characteristics at elevated temperatures (i.e. improved dimensional stability).

It is an object of the present invention to provide an improved process for the production of high strength polyester fibers wherein the as-spun filaments require substantially less drawing than is usually practiced to achieve high tenacity values.

It is an object of the present invention to provide a process for the production of polyester industrial fibers which are particularly suited for use as fibrous reinforcement in rubber tires.

It is an object of the present invention to provide a process for the production of high strength polyester fibers which exhibit significantly lower hysteresis characteristics (i.e. heat generating characteristics) than the polyester fibers of the prior art.

These and other objects will be apparent to those skilled in the art from the following description and appended claims.

SUMMARY OF THE INVENTION

It has been found that a process for the production of improved polyester filaments of high strength having an unusually stable internal structure which particularly are suited for use at elevated temperatures comprises:

(a) extruding a molten melt-spinnable polyester which contains 85 to 100 mol percent polyethylene terephthalate and 0 to 15 mol percent of copolymerized ester units other than polyethylene terephthalate having an intrinsic viscosity of 0.5 to 2.0 deciliters per gram through a shaped extrusion orifice having a plurality of openings to form a molten filamentary material, (b) passing the resulting molten filamentary material in the direction of its length through a solidification zone having an entrance end and an exit end wherein the molten filamentary material is uniformly quenched and transformed into a solid filamentary material, (c) withdrawing the solid filamentary material from the solidification zone while under a substantial stress of 0.015 to 0.150 gram per denier measured immediately below the exit end of the solidification zone, (d) continuously conveying the resulting as-spun filamentary material from the exit end of the solidification zone to a first stress isolation device with the filamentary material as it enters the first stress isolation device exhibiting a relatively high birefringence of $+9\times10^{-3}$ to $+70\times10^{-3}$.

(e) continuously conveying the resulting filamentary material from the first stress isolation device to a first draw zone, (f) continuously drawing the resulting filamentary material at a draw ratio of 1.01:1 to 3.0:1 while present in the first draw zone, and (g) subsequently thermally treating the previously drawn filamentary material while under a longitudinal tension and present at a temperature above that of the first draw zone to achieve at least 85 percent of the maximum draw ratio of the as-spun filamentary material and impart a tenacity of at least 7.5 grams per denier to the same, with at least the final portion of the thermal treatment being conducted at a temperature within the range from about 90° C. below the differential scanning calorimeter peak melting temperature of the same up to below the temperature at which filament coalescence occurs.

DESCRIPTION OF PREFERRED EMBODIMENTS

Figures 1, 2:
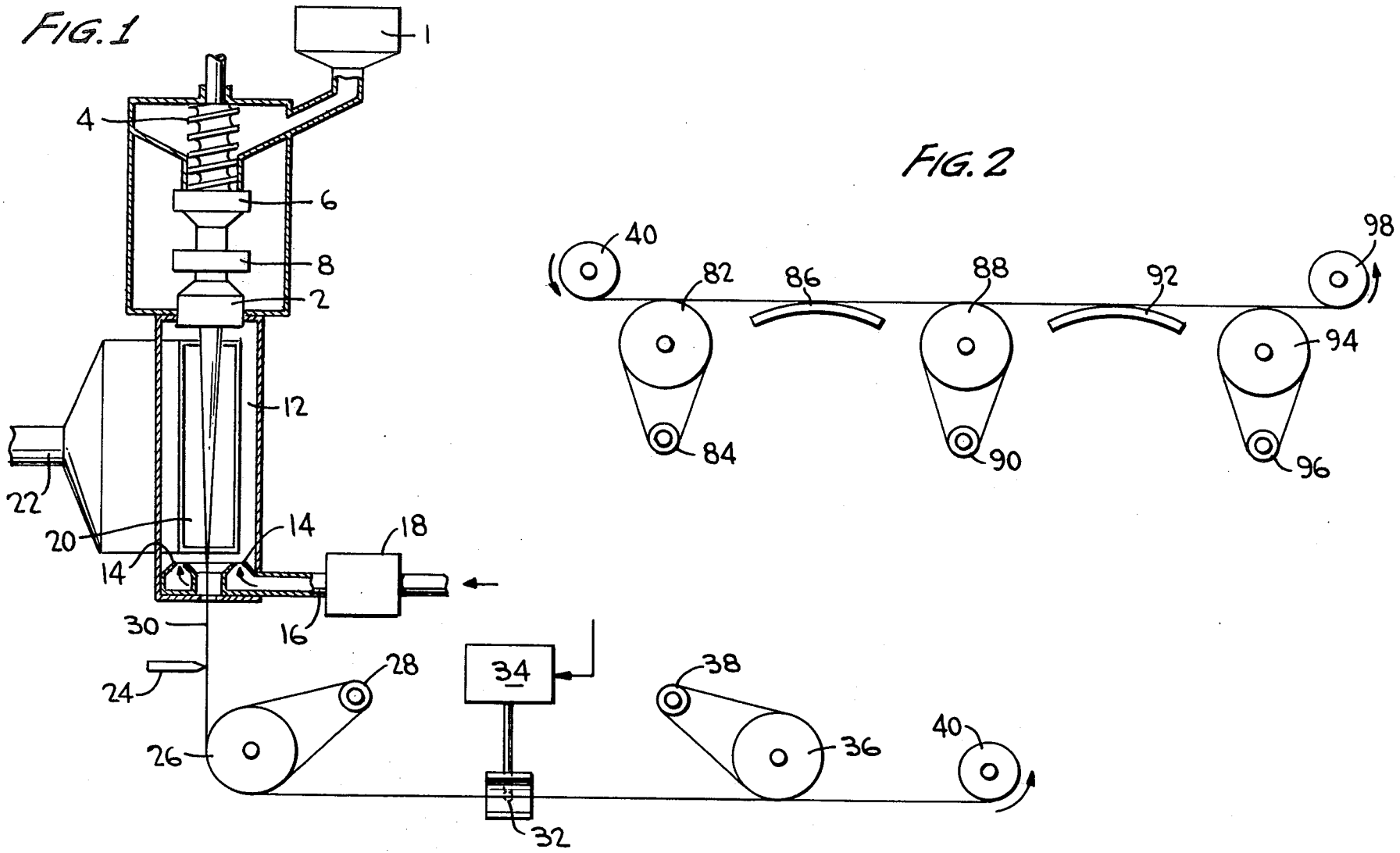
FIG. 1 illustrates a representative apparatus arrangement for carrying out steps (a) through (f) of the process of the present invention with the filamentary material being collected prior to step (g).
FIG. 2 illustrates a representative apparatus arrangement for carrying out step (g) of the present process wherein the filamentary material is thermally treated while under a longitudinal tension as it passes over a pair of heated draw shoes as described.

The melt-spinnable polyester for use in the present process is principally polyethylene terephthalate, and contains at least 85 mol percent polyethylene terephthalate, and preferably at least 90 mol percent polyethylene terephthalate. In a particularly preferred embodiment of the process the melt-spinnable polyester is substantially all polyethylene terephthalate. Alternatively, during the preparation of the polyester minor amounts of one or more ester-forming ingredients other than ethylene glycol and terephthalic acid or its derivatives may be copolymerized. For instance, the melt-spinnable polyester may contain 85 to 100 mol percent (preferably 90 to 100 mol percent) polyethylene terephthalate structural units and 0 to 15 mol percent (preferably 0 to 10 mol percent) copolymerized ester units other than polyethylene terephthalate. Illustrative examples of other ester-forming ingredients which may be copolymerized with the polyethylene terephthalate units include glycols such as diethylene glycol, trimethylene glycol, tetramethylene glycol, hexamethylene glycol, etc., and dicarboxylic acids such as isophthalic acid, hexahydroterephthalic acid, bibenzoic acid, adipic acid, sebacic acid, azelaic acid, etc.

The melt-spinnable polyester for use in the present process prior to extrusion is selected to have an intrinsic viscosity (I.V.) of about 0.5 to 2.0 deciliters per gram, and preferably a relatively high intrinsic viscosity of 0.8 to 2.0 deciliters per gram (e.g. 0.8 to 1 deciliter per gram), and most preferably 0.85 to 1 deciliters per gram (e.g. 0.9 to 0.95 deciliters per gram). The I.V. of the melt-spinnable polyester may be conveniently determined by the equation $(\lim/c\rightarrow o)\ (\ln\eta r/c)$, where $\eta r$ is the "relative viscosity" obtained by dividing the viscosity of a dilute solution of the polymer by the viscosity of the solvent employed (e.g. ortho-chlorophenol) measured at the same temperature, and c is the polymer concentration in the solution expressed in grams/100 ml. The starting polymer additionally commonly exhibits a degree of polymerization (D.P.) of about 140 to 420, and preferably of about 140 to 180. The polyethylene terephthalate starting material commonly exhibits a glass transition temperature of about 75° to 80° C. and a melting point of about 250° to 265° C., e.g., about 260° C.

The shaped extrusion orifice (i.e. the spinneret) has a plurality of openings and may be selected from among those commonly utilized during the melt extrusion of filamentary materials. The number of openings in the spinneret can be varied widely. A standard conical spinneret containing 6 to 600 holes (e.g. 20 to 400 holes), such as commonly used in the melt spinning of polyethylene terephthalate, having a diameter of about 5 to 50 mils (e.g., 10 to 30 mils) may be utilized in the process. Yarns of about 20 to 400 continuous filaments are commonly formed. The melt-spinnable polyester is supplied to the extrusion orifice at a temperature above its melting point and below the temperature at which the polymer degrades substantially.

A molten polyester consisting principally of polyethylene terephthalate is preferably at a temperature of about 270° to 325° C., and most preferably at a temperature of about 280° to 320° C. when extruded through the spinneret.

Following extrusion through the shaped orifice the resulting molten polyester filamentary material is passed in the direction of its length through a solidification zone having an entrance end and an exit end wherein the molten filamentary material uniformly is quenched and is transformed to a solid filamentary material. The quench employed is uniform in the sense that differential or asymmetric cooling is not contemplated. The exact nature of the solidification zone is not critical to the operation of the process provided a substantially uniform quench is accomplished. In a preferred embodiment of the process the solidification zone is a gaseous atmosphere provided at the requisite temperature. Such gaseous atmosphere of the solidification zone may be provided at a temperature below about 80° C. Within the solidification zone the molten material passes from the melt to a semi-solid consistency, and from the semi-solid consistency to a solid consistency. While present in the solidification zone the material undergoes substantial orientation while present as a semi-solid as discussed hereafter. The gaseous atmosphere present within the solidification zone preferably circulates so as to bring about more efficient heat transfer. In a preferred embodiment of the process the gaseous atmosphere of the solidification zone is provided at a temperature of about 10° to 60° C. (e.g. 10° to 50° C.) and most preferably at about 10° to 40° C. (e.g. at room temperature or about 25° C.). The chemical composition of the gaseous atmosphere is not critical to the operation of the process provided the gaseous atmosphere is not unduly reactive with the polymeric filamentary material. In a particularly preferred embodiment of the process the gaseous atmosphere of the solidification zone is air. Other representative gaseous atmospheres which may be selected for utilization in the solidification zone include inert gases such as helium, argon, nitrogen, etc.

As previously indicated, the gaseous atmosphere of the solidification zone impinges upon the extruded polyester material so as to produce a uniform quench wherein no substantial radial non-homogeneity or disproportional orientation exists across the product. The uniformity of the quench may be demonstrated through an examination of the resulting filamentary material by its ability to exhibit no substantial tendency to undergo self-crimping upon the application of heat. For instance, a yarn which has undergone a non-uniform quench in the sense the term is utilized in the present application will be self-crimping and undergo a spontaneous crimping when heated above its glass transition temperature while in a free-to-shrink condition.

The solidification zone is preferably disposed immediately below the shaped extrusion orifice and the extruded polymeric material is present while axially suspended therein for a residence time of about 0.0015 to 0.75 second, and most preferably for a residence time of about 0.065 to 0.25 second. Commonly the solidification zone possesses a length of about 0.25 to 20 feet, and preferably a length of 1 to 7 feet. The gaseous atmosphere is also preferably introduced at the lower end of the solidification zone and withdrawn along the side thereof with the moving continuous length of polymeric material passing downwardly therethrough from the spinneret. A center flow quench or any other technique capable of bringing about the desired quenching alternatively may be utilized.

The solid filamentary material next is withdrawn from the solidification zone while under a substantial stress of 0.015 to 0.150 gram per denier, and preferably under a substantial stress of 0.015 to 0.1 gram per denier (e.g. 0.015 to 0.06 gram per denier). The stress is measured at a point immediately below the exit end of the solidification zone. For instance, the stress may be measured by placing a tensionmeter on the filamentary material as it exits from the solidification zone. As will be apparent to those skilled in the art, the exact stress upon the filamentary material is influenced by the molecular weight of the polyester, the temperature of the molten polyester when extruded, the size of the spinneret openings, the polymer through-put rate during melt extrusion, the quench temperature, and the rate at which the as-spun filamentary material is withdrawn from the solidification zone. Commonly, the as-spun filamentary material is withdrawn from the solidification zone while under the substantial stress indicated at a rate of about 500 to 3000 meters per minute (e.g. at a rate of 1000 to 2000 meters per minute).

In the relatively high stress melt spinning process of the present invention the extruded filamentary material intermediate the point of its maximum die swell area and its point of withdrawal from the solidification zone commonly exhibits a substantial drawdown. For instance, the as-spun filamentary material may exhibit a drawdown ratio of about 100:1 to 3000:1, and most commonly a drawdown ratio of about 500:1 to 2000:1. The "drawdown ratio" as used above is defined as the ratio of the maximum die swell cross sectional area to the cross sectional area of the filamentary material as it leaves the solidification zone. Such substantial change in cross sectional area occurs almost exclusively in the solidification zone prior to complete quenching.

The as-spun filamentary material as it leaves the solidification zone commonly exhibits a denier per filament of about 4 to 80.

The as-spun filamentary material is conveyed in the direction of its length from the exit end of the solidification zone to a first stress isolation device. There is no stress isolation along the length of the filamentary material intermediate the shaped extrusion orifice (i.e. spinneret) and the first stress isolation device. The first stress isolation device can take a variety of forms as will be apparent in the art. For instance, the first stress isolation device can conveniently take the form of a pair of skewed rolls. The as-spun filamentary material may be wound in a plurality of turns about the skewed rolls which serve to isolate the stress upon the same as the filamentary material approaches the rolls from the stress upon the filamentary material as it leaves the rolls. Other representative devices which may serve the same function include: air jets, snubbing pins, ceramic rods, etc.

The relatively high spin-line stress upon the filamentary material yields a filamentary material of relatively high birefringence. For instance, the filamentary material as it enters the first stress isolation device exhibits a birefringence of $+9\times10^{-3}$ to $+70\times10^{-3}$ (e.g. $+9\times10^{-3}$ to $+40\times10^{-3}$), and preferably $+9\times10^{-3}$ to $+30\times10^{-3}$ (e.g. $+9\times10^{-3}$ to $+25\times10^{-3}$). In order to determine the birefringence of the filamentary material at this point in the process, a representative sample may be simply collected at the first stress isolation device and analyzed in accordance with conventional procedures at an off-line location. For instance, the birefringence of the filaments can be determined by using a Berek compensator mounted in a polarizing light microscope, which expresses the difference in the refractive index parallel and perpendicular to the fiber axis. The birefringence level achieved is directly proportional to stress exerted on the filamentary material as previously discussed. Prior art processes for the production of as-spun polyester filamentary materials ultimately intended for either textile or industrial applications have commonly been carried out under relatively low stress spinning conditions and have yielded as-spun filamentary materials of a considerably lower birefringence (e.g. a birefringence of about $+1\times10^{-3}$ to $+2\times10^{-3}$).

The as-spun filamentary material continuously is conveyed in the direction of its length from the first stress isolation device to a first draw zone where it is drawn on a continuous basis while passing through the first draw zone under longitudinal tension. While present in the first draw zone the as-spun filamentary material preferably is drawn at least 50 percent of its maximum draw ratio (e.g. about 50 to 80 percent of the maximum draw ratio). The "maximum draw ratio" of the as-spun filamentary material is defined as the maximum draw ratio to which the as-spun filamentary material may be drawn on a practical and reproducible basis without encountering breakage thereof. For instance, the maximum draw ratio of the as-spun filamentary material may be determined by drawing the same in a plurality of stages at successively elevated temperatures, and empirically observing the practical upper limit for the overall draw ratio for all stages, with the first draw stage being conducted in an in-line manner immediately after spinning.

The draw ratio utilized in the first draw zone ranges from 1.01:1 to 3.0:1, and preferably from 1.4:1 to 3.0:1 (e.g. about 1.7:1 to 3.0:1). Such draw ratios are based upon roll surface speeds immediately before and after the draw zone. The lower draw ratios within this range are commonly but not necessarily employed in conjunction with as-spun filaments of the higher birefringence levels specified, and the higher draw ratios with the lower birefringence levels specified. The apparatus utilized to carry out the requisite degree of drawing in the first draw zone can be varied widely. For instance, the first draw step can be conveniently carried out by passing the filamentary material in the direction of its length through a steam jet while under longitudinal tension. Other drawing equipment utilized with polyesters in the prior art likewise may be employed. At the completion of the first draw step of the present process the filamentary material commonly exhibits a tenacity of about 3 to 5 grams per denier measured at 25° C.

It has been found to be essential in accordance with our experimental investigations that the first draw step of the present process be carried out on a continuous basis immediately following spinning and solidification if one is ultimately to achieve a filamentary product having the desired internal structure and physical properties. For instance, if the filamentary material is collected at the exit end of the solidification zone, stored for 24 hours at ambient conditions, and then subjected to drawing, the drawing characteristics were found to be modified (i.e. the maximum attainable draw ratio was reduced), and it was found to be impossible to draw the same to achieve the desired tensile properties.

The filamentary material following the first draw step is thermally treated while under a longitudinal tension at a temperature above that of the first draw zone. The thermal treatment may be carried out in an in-line continuous manner immediately following passage from the first draw zone, or the filamentary material may be collected after passage through the first draw zone and finally subjected to the thermal treatment at a later time. The thermal treatment preferably is carried out in a plurality of steps at successively elevated temperatures. For instance, the thermal treatment conveniently may be carried out in two, three, four or more stages. The nature of the heat transfer media utilized during the thermal treatment may be varied widely. For instance, the heat transfer medium may be a heated gas, or a heated contact surface, such as one or more hot shoes or hot rollers. The longitudinal tension utilized preferably is sufficient to prevent shrinkage during each stage of the thermal treatment under discussion; however, not every step need be a draw step with one or more of the steps being carried out at substantially constant length. During the thermal treatment the filamentary material is drawn to achieve at least 85 percent of the maximum draw ratio (previously discussed), and preferably at least 90 percent of the maximum draw ratio.

The thermal treatment imparts a tenacity of at least 7.5 grams per denier to the filamentary material measured at 25° C., and preferably a tenacity of at least 8 grams per denier. The tensile properties referred to herein may be determined through the utilization of an Instron tensile tester (Model TM) using a $3\frac{1}{3}$ inch gauge length and a strain rate of 60 percent per minute in accordance with ASTM D2256. The fibers prior to testing are conditioned for 48 hours at 70° F. and 65 percent relative humidity in accordance with ASTM D1776.

It is essential that the final portion of the thermal treatment be carried out at a temperature within the range from about 90° C. below the differential scanning calorimeter peak melting temperature of the filamentary material up to below the temperature at which coalescence of adjoining filaments occurs. In a preferred embodiment of the process the final portion of the thermal treatment is carried out at a temperature within the range from 60° C., below the differential scanning calorimeter peak melting temperature up to below the temperature at which coalescence of adjoining filaments occurs. For a polyester filamentary material which is substantially all polyethylene terephthalate the differential scanning calorimeter peak melting temperature of the filamentary material is commonly observed to be about 260° C. The final portion of the thermal treatment commonly is carried out at a temperature of about 220° to 250° C. in the absence of filament coalescence.

If desired, an optional shrinkage step may be carried out wherein the filamentary material resulting from the thermal treatment previously described is allowed to shrink slightly, and thereby slightly to alter the properties thereof. For instance, the resulting filamentary material may be allowed to shrink up to about 1 to 10 percent (preferably 2 to 6 percent) by heating at a temperature above that of the final portion of the thermal treatment while positioned between moving rolls having a ratio of surface speeds such to allow the desired shrinkage. Such optional shrinkage step tends further to reduce the residual shrinkage characteristics and to increase the elongation of the final product.

The multifilament yarn which is produced by the process of the present invention commonly possesses a denier per filament of about 1 to 20 (e.g. about 3 to 15), and commonly consists of about 6 to 600 continuous filaments (e.g. about 20 to 400 continuous filaments). The denier per filament and the number of continuous filaments present in the yarn may be varied widely by adjusting process parameters as will be apparent to those skilled in the art.

The filamentary product particularly is suited for use in industrial applications wherein high strength polyester fibers have been utilized in the prior art. The novel internal structure (discussed hereafter) of the filamentary material has been found to be unusually stable and renders the fibers particularly suited for use in environments where elevated temperatures (e.g. 80° to 180° C.) are encountered. Not only does the filamentary material undergo a relatively low degree of shrinkage for a high strength product, but exhibits an unusually low degree of hysteresis or work loss during use in environments wherein it is repeatedly stretched and relaxed.

The multifilament yarn product is non-self-crimping and exhibits no substantial tendency to undergo self-crimping upon the application of heat. The yarn may be conveniently tested for a self-crimping propensity by heating by means of a hot air oven to a temperature above its glass transition temperature, e.g. to 100° C. while in a free-to-shrink condition. A self-crimping yarn will spontaneously assume a random non-linear configuration, while a non-self-crimping yarn will tend to retain its original linear configuration while possibly undergoing some shrinkage.

The unusually stable internal structure of the filamentary material is evidenced by the following novel combination of characteristics:

(a) a birefringence value of +0.160 to +0.189, (b) a stability index value of 6 to 45 obtained by taking the reciprocal of the product resulting from multiplying the shrinkage at 175° C. in air measured in percent times the work loss at 150° C. between a stress cycle of 0.6 gram per denier and 0.05 gram per denier measured at a constant strain rate of 0.5 inch per minute in inch-pounds on a 10 inch length of yarn normalized to that of a multifilament yarn of 1000 total denier, and (c) a tensile index value greater than 825 (e.g. 830 to 2500 or 830 to 1500) measured at 25° C. and obtained by multiplying the tenacity expressed in grams per denier times the initial modulus expressed in grams per denier.

Figure 5:
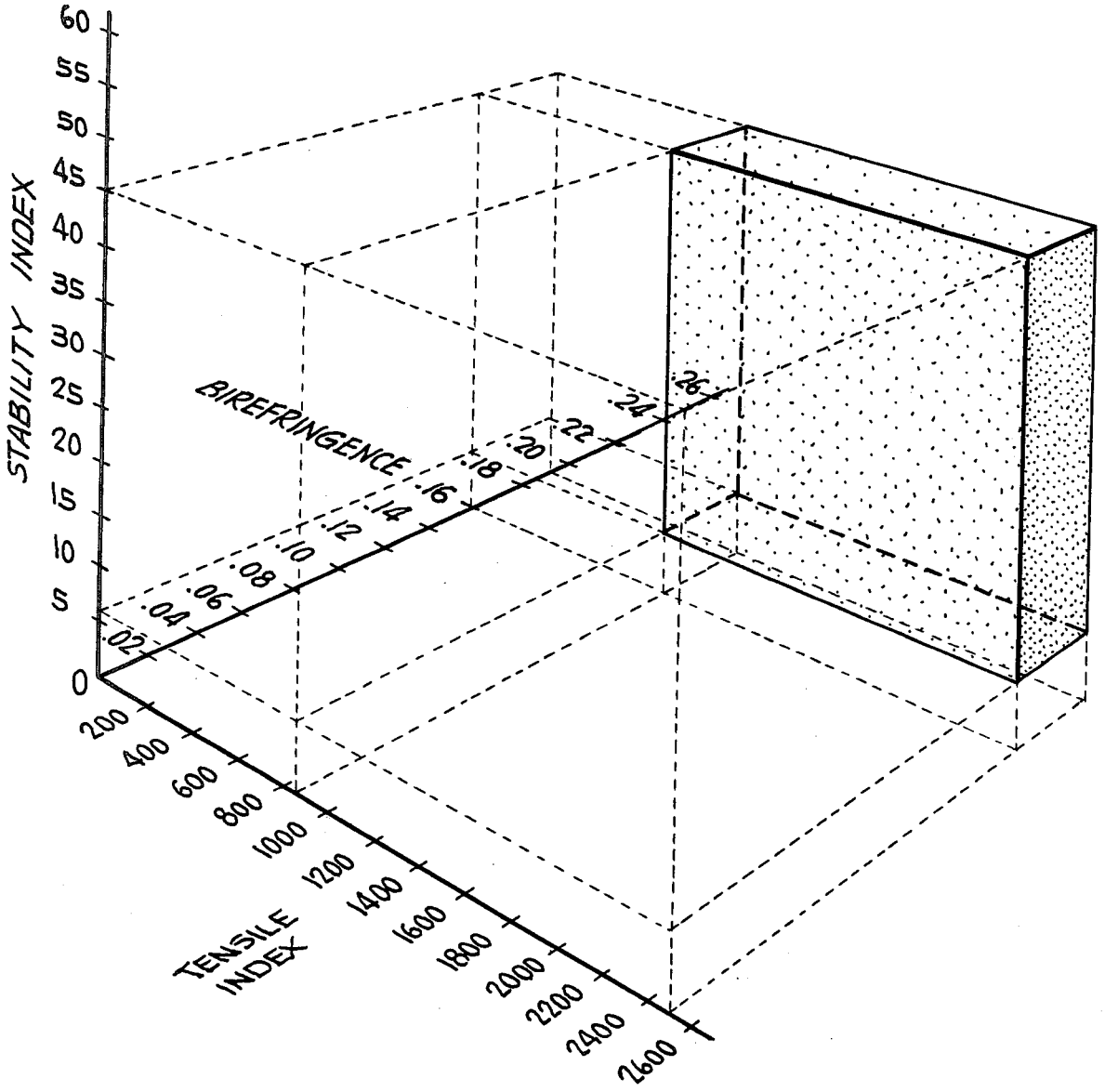
FIG. 5 illustrates a three dimensional presentation which plots the birefringence (+0.160 to +0.189), the stability index value (6 to 45), and the tensile index value (830 to 2500) of an improved polyester multifilament yarn which may be formed by the process of the present invention possessing an unusually stable internal structure as evidenced by the novel combination of characteristics set forth. These characteristics of the resulting filamentary material are discussed in detail hereafter.

See FIG. 5 which illustrates a three dimensional presentation which plots the birefringence, the stability index value, and the tensile value of an improved polyester yarn which may be formed by the process of the present invention.

Stated differently the unusually stable internal structure of the filamentary material is evidenced by the following novel combination of characteristics:

(a) a crystallinity of 45 to 55 percent, (b) a crystalline orientation function of at least 0.97, (c) an amorphous orientation function of 0.37 to 0.60, (d) a shrinkage less than 8.5 percent in air at 175° C., and (e) an initial modulus of at least 110 grams per denier at 25° C. (e.g. 110 to 150 grams per denier), (f) a tenacity of at least 7.5 grams per denier at 25° C. (e.g. 7.5 to 10 grams per denier) and preferably at least 8 grams per denier at 25° C., and (g) a work loss of 0.004 to 0.02 inch-pounds between a stress cycle of 0.6 gram per denier and 0.05 gram per denier at 150° C. measured at a constant strain rate of 0.5 inch per minute on a 10 inch length of yarn normalized to that of a multifilament yarn of 1000 total denier.

As will be apparent to those skilled in the art, the birefringence of the product is measured on representative individual filaments of the multifilament yarn and is a function of the filament crystalline portion and the filament amorphous portion. See, for instance, the article by Robert J. Samuels in *J. Polymer Science,* A2, 10, 781 (1972). The birefringence may be expressed by the equation:

$$\Delta n = Xf_c\Delta n_c + (1-X)f_a\Delta n_a + \Delta n_f \quad (1)$$

where $\Delta n$ = birefringence

X = fraction crystalline $f_c$ = crystalline orientation function $\Delta n_c$ = intrinsic birefringence of crystal (0.220 for polyethylene terephthalate)

$f_a$ = amorphous orientation function $\Delta n_a$ = intrinsic birefringence of amorphous (0.275 for polyethylene terephthalate)

$\Delta n_f$ = form birefringence (values small enough to be neglected in this system)

The birefringence of the product may be determined by using a Berek compensator mounted in a polarizing light microscope, and expresses the difference in the refractive index parallel and perpendicular to the fiber axis. The fraction crystalline, X, may be determined by conventional density measurements. The crystalline orientation function, $f_c$, may be calculated from the average orientation angle, $\theta$, as determined by wide angle x-ray diffraction. Photographs of the diffraction pattern may be analyzed for the average angular breadth of the (010) and (100) diffraction arcs to obtain the average orientation angle, $\theta$. The crystalline orientation function, $f_c$, may be calculated from the following equation:

$$f_c = \tfrac{1}{2}(3\cos^2\theta - 1) \quad (2)$$

Once $\Delta n$, X, and $f_c$ are known, $f_a$, may be calculated from equation (1), $\Delta n_c$ and $\Delta n_a$ are intrinsic properties of a given chemical structure and will change somewhat as the chemical constitution of the molecule is altered, i.e., by copolymerization, etc.

The birefringence value exhibited by the product of the present process of +0.160 to +0.189 (e.g. +0.160 to +0.185) tends to be lower than that exhibited by filaments from commercially available polyethylene terephthalate tire cords formed via a relatively low stress spinning process followed by substantial drawing outside the spinning column. For instance, filaments from commercially available polyethylene terephthalate tire cords commonly exhibit a birefringence value of about +0.190 to +0.205. Additionally, as reported in commonly assigned U.S. Pat. No. 3,946,100 the product of that process involving the use of a conditioning zone immediately below the quench zone in the absence of stress isolation exhibits a substantially lower birefringence value than that of the filaments formed by the present process. For instance, polyethylene terephthalate filaments formed by the process of U.S. Pat. No. 3,946,100 exhibit a birefringence value of about +0.100 to +0.140.

Since the crystallinity and crystalline orientation function ($f_c$) values for the product tend to be substantially the same as those of commercially available polyethylene terephthalate tire cords, it is apparent that the product of the process is substantially fully drawn crystallized fibrous material. However, the amorphous orientation function ($f_a$) value for the product (i.e. 0.37 to 0.60) is lower than that exhibited by commercially available polyethylene terephthalate tire cord yarns having equivalent tensile properties (i.e. tenacity and initial modulus). For instance, amorphous orientation values of at least 0.64 (e.g. 0.8) are exhibited in commercially available tire cord yarns.

The product characterization parameters referred to herein other than birefringence, crystallinity, crystalline orientation function, and amorphous orientation function may conveniently be determined by testing the resulting multifilament yarns consisting of substantially parallel filaments. The entire multifilament yarn may be tested, or alternatively, a yarn consisting of a large number of filaments may be divided into a representative multifilament bundle of a lesser number of filaments which is tested to indicate the corresponding properties of the entire larger bundle. The number of filaments present in the multifilament yarn bundle undergoing testing conveniently may be about 20. The filaments present in the yarn during testing are untwisted.

The highly satisfactory tenacity values (i.e. at least 7.5 grams per denier), and initial modulus values (i.e. at least 110 grams per denier) of the product of the present process compare favorably with these particular parameters exhibited by commercially available polyethylene terephthalate tire cord yarns and may be determined in accordance with ASTM D2256 as previously indicated.

The high strength multifiliment product of the present process possesses an internal morphology which manifests an unusually low shrinkage propensity of less than 8.5 percent, and preferably less than 5 percent when measured in air at 175° C. For instance, filaments of commercially available polyethylene terephthalate tire cord yarns commonly shrink about 12 to 15 percent when tested in air at 175° C. These shrinkage values may be determined through the utilization of a DuPont Thermomechanical Analyzer (Model 941) operated under zero applied load and at a 10° C./min, heating rate with the gauge length held constant at 0.5 inch. Such improved dimensional stability is of particular importance if the product serves as fibrous reinforcement in a radial tire.

The unusually stable internal structure of the product of the present invention is further manifest in its low work loss or low hysteresis characteristics (i.e. low heat generating characteristics) in addition to its relatively low shrinkage propensity for a high strength fibrous material. The product of the present invention exhibits a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn normalized to that of a multifilament yarn of 1000 total denier as described hereafter. On the contrary such work loss characteristics of commercially available polyethylene terephthalate tire cord yarn (which was initially spun under relatively low stress conditions of about 0.002 gram per denier to form an as-spun yarn having a birefringence of $+1$ to $+2\times10^{-3}$, and subsequently was drawn to develop the desired tensile properties) is about 0.045 to 0.1 inch-pounds under the same conditions. The work loss characteristics referred to herein may be determined in accordance with the slow speed test procedure described in "A Technique for Evaluating the Hysteresis Properties of Tire Cords", by Edward J. Powers appearing in *Rubber Chem. and Technol.*, 47, No. 5, December, 1974, pages 1053–1065, and additionally is described in detail hereafter.

As bias ply tires rotate, the cords which serve as fibrous reinforcement are cyclically loaded (see R. G. Patterson, *Rubber Chem. Technol.*, 42, 1969, page 812). Typically, more work is done in loading (stretching) a material than is recovered during unloading (relaxation). And, the work loss, or hysteresis, is dissipated as heat which raises the temperature of the cyclically deformed material. (T. Alfrey, "Mechanical Behavior of High Polymers", Interscience Publishers, Inc., New York, 1948, page 200; J. D. Ferry, "Viscoelastic Properties of Polymers", John Wiley and Sons, Inc., New York, 1970, page 607; E. H. Andrews in "Testing of Polymers", 4, W. E. Brown, Ed., Interscience Publishers, New York, 1969, pages 248–252.)

As described in the above-identified article by Edward J. Powers the work loss test which yields the identified work loss values is dynamically conducted and simulates a stress cycle encountered in a rubber vehicle tire during use wherein the polyester fibers serve as fibrous reinforcement. The method of cycling was selected on the basis of results published by Patterson (*Rubber Chem. Technol.*, 42, 1969, page 812) wherein peak loads were reported to be imposed on cords by tire air pressure and unloading was reported to occur in cords going through a tire foot print. For slow speed test comparisons of yarns, a peak stress of 0.6 gram per denier and a minimum stress of 0.05 gram per denier were selected as being within the realm of values encountered in tires. A test temperature of 150° C. was selected. This would be a severe operating tire temperature, but one that is representative of the high temperature work loss behavior of tire cords. Identical lengths of yarn (10 inches) are consistently tested and work loss data are normalized to that of a 1000 total denier yarn. Since denier is a measure of mass per unit length, the product of length and denier ascribes a specific mass of material which is a suitable normalizing factor for comparing data.

Generally stated the slow speed test procedure employed allows one to control the maximum and minimum loads and to measure work. A chart records load (i.e. force or stress on the yarn) versus time with the chart speed being synchronized with the cross head speed of the tensile tester utilized to carry out the test. Time can accordingly be converted to the displacement of the yarn undergoing testing. By measuring the area under the force-displacement curve of the tensile tester chart, the work done on the yarn to produce the deformation results. To obtain work loss, the area under the unloading (relaxation) curve is subtracted from the area under the loading (stretching) curve. If the unloading curve is rotated, 180° about a line drawn vertically from the intercept of the loading and unloading curves, a typical hysteresis loop results. Work loss is the force-displacement integral within the hysteresis loop. These loops would be generated directly if the tensile tester chart direction was reversed syncronously with the loading and unloading directions of the tensile tester cross head. However, this is not convenient, in practice, and the area within the hysteresis loop may be determined arithmetically.

As previously indicated, comparisons of the results of the slow speed work loss procedure indicate that chemically identical polyethylene terephthalate multifilament yarns which are formed by differing types of processing exhibit significantly different work loss behavior. Such differing test results can be attributed to significant variations in the internal morphology of the same. Since the work loss is converted to heat the test offers a measure of the heat producing characteristic that comparable yarns or cords will have during deformations similar to those encountered in a loaded rolling tire. If the morphology of a given cord or yarn is such that it produces less heat per cycle, i.e. in one tire revolution, then its rate of heat generation will be lower at higher frequencies of deformation, i.e. higher tire speeds, and its resultant temperature will be lower than that of a yarn or cord which produces more heat per cycle.

Figure 3:
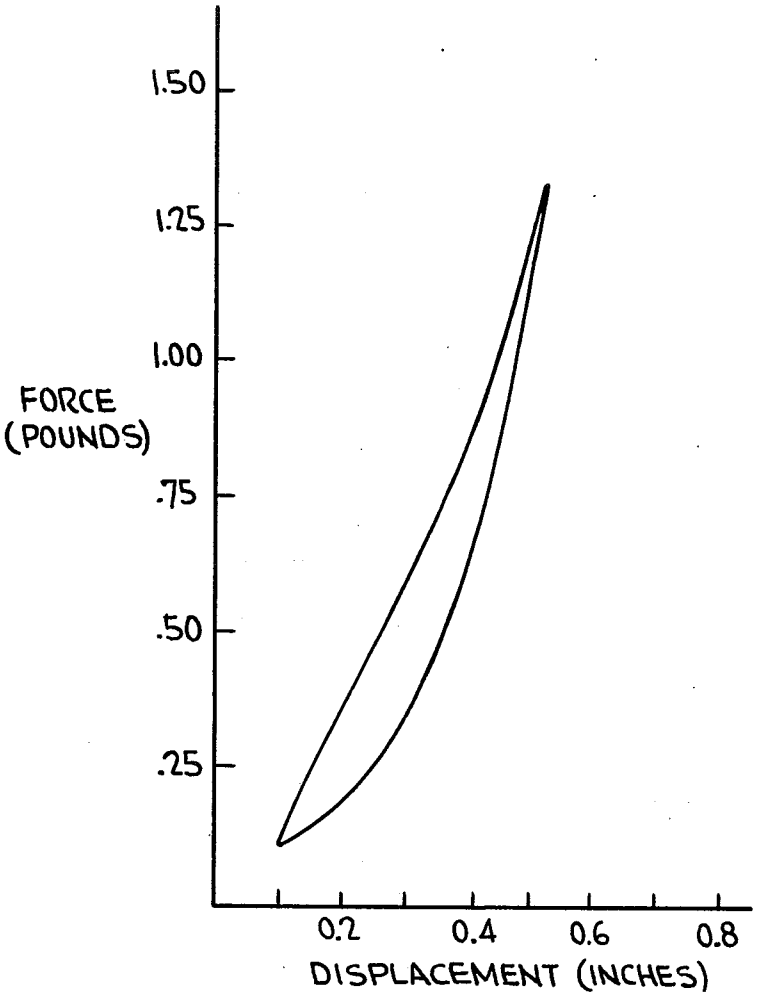
FIG. 3 illustrates a representative hysteresis (i.e. work loss) loop for a conventional 1000 denier polyethylene terephthalate tire cord yarn of the prior art having a length of 10 inches.
Figure 4:
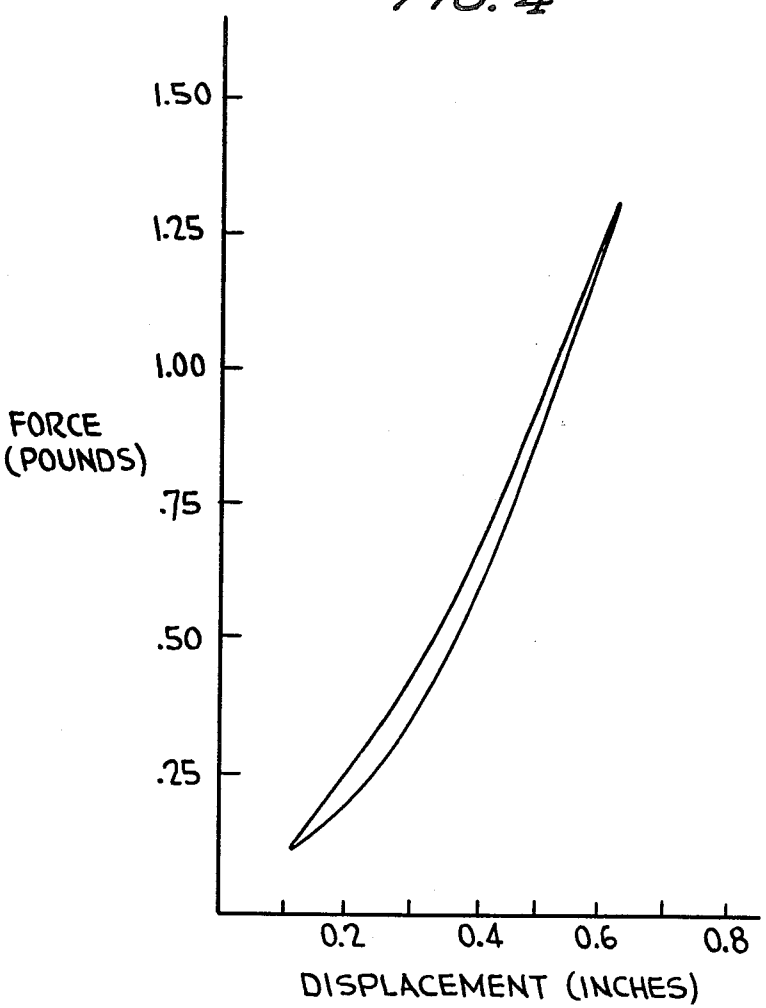
FIG. 4 illustrates a representative hysteresis (i.e. work loss) loop for a 1000 denier polyethylene terephthalate tire cord yarn consisting of fibers formed in accordance with the present process having a length of 10 inches.

FIGS. 3 and 4 illustrate representative hysteresis (i.e. work loss) loops for 10 inch lengths of 1000 denier polyethylene terephthalate tire cord yarns of high strength formed by differing processing techniques which yield products having different internal structures. FIG. 3 is representative of the hysteresis curve for a conventional polyethylene terephthalate tire cord yarn wherein the filamentary material is initially spun under relatively low stress conditions of about 0.002 gram per denier to form an as-spun yarn having a birefringence of $+1$ to $+2\times10^{-3}$ and which is subsequently drawn to develop the desired tensile properties. FIG. 4 illustrates a respresentative hysteresis loop for a polyethylene terephthalate tire cord yarn consisting of fibers formed in accordance with the present process.

Set forth below is a detailed description of the slow speed test procedure for determining the work loss value for a given multifilament yarn employing an Instron Model TTD tensile tester with oven, load cell, and chart.

A. Heat oven to 150° C.

B. Determine denier of yarn to be tested.

C. Calibrate equipment.

Set full scale load (FSL) to impose 1 gram per denier stress on the yarn at full scale. Set cross head speed for 0.5 inch per minute.

D. Sample placement.

With the equipment at the test temperature the yarn is clamped in the upper jaw and held in 0.01 gram per denier stress (g/d) as the lower jaw is fastened. Care should be exercised to place the yarn quickly, avoiding excessive shrinkage of the sample. The gauge length of yarn to be tested should be 10 inches.

E. Run test.

1. Start chart.
2. Start crosshead-down.
3. At the load which produces 0.6 g/d stress reverse corsshead.
4. At the load which produces 0.5 g/d stress reverse crosshead.
5. Cycle four times between 0.6 and 0.5 gram per denier.
6. On the next crosshead-up, reverse the crosshead motion at 0.4 g/d.
7. Cycle between 0.6 g/d and 0.4 g/d for four cycles.
8. On the next crosshead-up, reverse crosshead motion at 0.3 g/d.
9. Continue in this fashion, cycling between 0.6 g/d and 0.3 g/d for four cycles, then between 0.6 g/d and 0.2 g/d for four cycles, then between 0.6 g/d and 0.1 g/d for four cycles, and finally between 0.6 g/d and 0.05 g/d for four cycles.

F. Data Collection

For work loss per cycle per 10 inch length of yarn normalized to that of a yarn of 1000 total denier the following formula may be used. Use only the data from the fourth cycle of the 0.6 g/d to 0.05 g/d load cycle when determining the work loss referred to herein.

$$W = Ac \times \frac{FSL \times CHS}{A_l} \times \frac{1000}{\text{yarn denier}}$$

W = work (inch-pounds/cycle/1000 denier-10 inch)
$A_c$ = area under curve (either loading or unloading)
FSL = full scale load (pounds)
CHS = crosshead speed (inches/minute)
$A_l$ = area generated by pen at full scale load for one minute
Work Loss = $W_I - W_O$
$W_I$ = work done to load sample
$W_O$ = work recovered during relaxation The areas $A_c$ and $A_l$ can be determined by any number of methods as counting small squares or using a polar planimeter.

It is also possible to make a copy of the curve, cut out the curves and weigh the paper. However, care must be exercised in allowing the paper to reach a reproducible equilibrium moisture content. By this method the previous formula for determining work becomes:

$$W = \frac{Wt_c \times FSL \times CHS}{Wt_T} \times \frac{1000}{\text{yarn denier}}$$

W = work (inch-pounds/cycle/1000 denier-10 inch)
$Wt_c$ = weight of cut out curve (e.g. in grams)
FSL = as above
CHS = as above
$Wt_T$ = weight of area of paper generated by the full scale load for one minute (e.g. in grams)

The above formula for work loss is the same.

It should be noted that the test can be automated and data collection facilitated by interfacing a digital integrator with the Instron tensile tester as described in the above-identified article by Edward J. Powers.

There is disagreement in the literature as to the relative percentages of total heat in a tire produced by the cords, rubber, road friction etc. See F. S. Conant, *Rubber Chem. Technol.*, 44, 1971, page 297; P. Kainradl and G. Kaufmann, *Rubber Chem. Technol.*, 45, 1972 page 1; N. M. Trivisonno, "Thermal Analysis of a Rolling Tire", SAE Paper 7004 4, 1970; P. R. Willett, *Rubber Chem. Technol.*, 46, 1973, page 425; J. M. Collins, W. L. Jackson and P. S. Oubridge, *Rubber Chem. Technol*, 38, 1965, page 400. However, the cords are the load bearing element in tires and as their temperature increases several undesirable consequences follow. As temperatures increase, the heat generated per cycle by the cords generally increases. It is well known that rates of chemical degradation increase with increasing temperature. And, it is also well known that fiber moduli decrease as the cord temperatures increase which permits greater strains in the tire to increase the heat generated in the rubber. All of these factors will tend to increase the temperature of cords still further and if the increases are great enough, tire failure can result. It is obvious that optimum cord performance, particularly in critical applications, will result from cords having a minimal heat generating characteristic (work loss per cycle per unit quantity of cord).

Additionally, it has been found that the fibrous product of the present process exhibits greatly improved fatigue resistance when compared to high strength polyethylene terephthalate fibers conventionally utilized to form tire cords. Such fatigue resistance enables the fibrous reinforcement when embedded in rubber to better withstand bending, twisting, shearing, and compression. The superior fatigue resistance of the product of the present invention can be demonstrated through the use of (1) the Goodyear Mallory Fatigue Test (ASTM-D-885-59T), or (2) the Firestone-Shear-Compression-Extension Fatigue Test (SCEF). For instance, it has been found that when utilizing the Goodyear Mallory Fatigue test which combines compression with internal temperature generation, the product of the present invention runs about 5 to 10 times longer than the conventional polyester tire cord control, and the test tubes run about 50° F. cooler than the control. In the Firestone-Shear-Compression-Extension Fatigue Test which simulates sidewall flexing the product of the present invention outperformed the conventional polyester tire cord control by about 400 percent at equal twist.

The following examples are given as specific illustrations of the process of the present invention with reference being made to FIGS. 1 and 2 of the drawings. It should be understood, however, that the invention is not limited to the specific details set forth in the examples.

Polyethylene terephthalate having an intrinsic viscosity (I V.) of 0.9 deciliters per gram was selected as the starting material. The intrinsic viscosity was determined from a solution of 0.1 gram of polymer in 100 ml. of ortho-chlorophenol at 25° C.

As illustrated in FIG. 1, the polyethylene terephthalate polymer while in particulate form was placed in hopper 1 and was advanced toward spinneret 2 by the aid of screw conveyor 4. Heater 6 caused the polyethylene terephthalate particles to melt to form a homogeneous phase which was further advanced toward spinneret 2 by the aid of pump 8. The spinneret 2 had a standard conical entrance and a ring of extrusion holes, each having a diameter of 10 mils.

The resulting extruded polyethylene terephthalate 10 passed directly from the spinneret 2 through solidification zone 12. The solidification zone 12 had a length of 6 feet and was vertically disposed. Air at 10° C. was continuously introduced into solidification zone 12 at 14 which was supplied via conduit 16 and fan 18. The air was continuously withdrawn from solidification zone 12 through elongated conduit 20 vertically disposed in communication with the wall of solidification zone 12, and from there was continuously withdrawn through conduit 22. While passing through the solidification zone, the extruded polyethylene terephthalate was uniformly quenched and was transformed into a continuous length of as-spun polyethylene terephthalate yarn. The polymeric material was first transformed from a molten to a semi-solid consistency, and then from a semi-solid consistency to a solid consistency while passing through solidification zone 12.

After leaving the exit end of solidification zone 12 the filamentary material lightly contacted lubricant applicator 24 and was continuously conveyed to a first stress isolation device consisting of a pair of skewed rolls 26 and 28, and was wrapped about these in four turns. The filamentary material was passed from skewed rolls 26 and 28 to a first draw zone consisting of a steam jet 32 through which steam tangentially was sprayed upon the moving filamentary material from a single orifice. High pressure steam at 25 psig initially was supplied to superheater 34 where it was heated to 250° C., and then was conveyed to steam jet 32. The filamentary material was raised to a temperature of about 85° C. when contacted by the steam and drawn in the first draw zone. The longitudinal tension sufficient to accomplish drawing in the first draw zone was created by regulating the speed of a second pair of skewed rolls 36 and 38 about which the filamentary material was wrapped in four turns. The filamentary material was next packaged at 40.

FIG. 2 illustrates the equipment arrangement wherein the subsequent thermal treatment was carried out. The resulting package 40 subsequently was unwound and passed in four turns about skewed rolls 82 and 84 which served as a stress isolation device. From skewed rolls 82 and 84 the filamentary material was passed in sliding contact with hot shoe 86 having a length of 24 inches which served as a second draw zone and was maintained under longitudinal tension exerted by skewed rolls 88 and 90 about which the filamentary material was wrapped in four turns. Hot shoe 86 was maintained at a temperature above that experienced by the filamentary material in the first draw zone. The filamentary material after being conveyed from skewed rolls 88 and 90 was passed in sliding contact with hot shoe 92 having a length of 24 inches which served as the zone wherein the final portion of the thermal treatment was carried out. Skewed rolls 94 and 96 maintained a longitudinal tension upon the filamentary material as it passed over hot shoe 92. The filamentary material assumed substantially the same temperature as hot shoes 86 and 92 while in sliding contact with the same. The differential scanning calorimeter peak melting temperature of the filamentary material was 260° C. in each Example, and no filament coalescence occurred during the thermal treatment illustrated in FIG. 2. Further details concerning the Examples are specified hereafter.

EXAMPLE I

The spinneret 2 consisted of 20 holes, and the polyethylene terephthalate was at a temperature of about 316° C. when extruded. The polyester throughput through a spinneret 2 was 12 grams per minute and the spinning pack pressure was 1550 psig.

The relatively high stress exerted upon the filamentary material at the exit end of the solidification zone 12 as measured at point 30 was 0.019 gram per denier. The as-spun filamentary material was wrapped about skewed rolls 26 and 28 at a rate of 500 meters per minute, and at that point in the process exhibited a relatively high birefringence of $+9.32\times10^{-3}$, and a total denier of 216. The maximum draw ratio for the as-spun filamentary material prior to entering the first draw zone was approximately 4.2:1.

Summarized in Table I which follows are additional process parameters and results achieved for a plurality of runs in accordance with the process of the present invention wherein the conditions of the (1) first draw, (2) second draw, and (3) final portion of the thermal treatment were varied through an adjustment of the relative speeds of skewed rolls 36 and 38, 82 and 84, 88 and 90, and 94 and 96, as well as the temperatures of hot shoes 86 and 92.

In Table I, as well as in the other Tables which follow the following abbreviations and terms are utilized.

DR=draw ratio expressed :1 based on the ratio of roll surface speeds

TEN=yarn tenacity in grams per denier measured at 25° C.

E=yarn elongation in percent measured at 25° C.

IM=yarn initial modulus in grams per denier measured at 25° C.

Max. DR=maximum draw ratio expressed :1 to which the as-spun yarn may be drawn on a practical and reproducible basis without breakage DPF=denier per filament Shrinkage=longitudinal shrinkage measured at 175° C. in air in percent Work Loss = work loss at 150° C. when cycled between a stress of 0.6 gram per denier and 0.05 gram per denier measured at a constant strain rate of 0.5 inch per minute in inch-pounds measured on a 10 inch length of yarn normalized to that of a multifilament yarn of 1000 total denier as described herein.

Stability Index = the reciprocal of the product resulting from multiplying the shrinkage times the work loss Tensile Index = the product obtained by multiplying the tenacity times the initial modulus filamentary material prior to entering the first draw zone was approximately 3.2:1.

Summarized in Table II which follows are additional process parameters and results achieved for a plurality of runs in accordance with the process of the present invention wherein the conditions of the (1) first draw, (2) second draw, and (3) final portion of the thermal treatment were varied through an adjustment of the relative speeds of skewed rolls 36 and 38, 82 and 84, 88 and 90, and 94 and 96, as well as the temperatures of hot shoes 86 and 92.

TABLE II

| Run | FIRST DRAW | | | | SUBSEQUENT THERMAL TREATMENT: SECOND DRAW | | | | | SUBSEQUENT THERMAL TREATMENT: FINAL PORTION OF THERMAL TREATMENT | | | | | | Drawn to % |
|---|---|---|---|---|---|---|---|---|---|---|---|---|---|---|---|---|
| No. | DR | TEN | E | IM | DR | DT | TEN | E | IM | DR | DT | TEN | E | IM | Total DR | Max. DR |
| 1 | 2.11 | 4.20 | 41.67 | 76 | 1.38 | 180 | 7.72 | 8.20 | 116 | 1.06 | 220 | 8.47 | 7.43 | 147 | 3.09 | 97 |
| 2 | 2.11 | 4.20 | 41.67 | 76 | 1.38 | 180 | 7.72 | 8.20 | 116 | 1.06 | 240 | 8.54 | 7.34 | 151 | 3.09 | 97 |
| 3 | 2.11 | 4.20 | 41.67 | 76 | 1.38 | 200 | 8.02 | 8.28 | 113 | 1.06 | 220 | 8.46 | 7.37 | 146 | 3.09 | 97 |
| 4 | 2.11 | 4.20 | 41.67 | 76 | 1.38 | 200 | 8.02 | 8.28 | 113 | 1.06 | 240 | 8.25 | 7.43 | 148 | 3.09 | 97 |
| 5 | 2.25 | 4.56 | 36.62 | 81 | 1.34 | 190 | 8.01 | 8.07 | 120 | 1.06 | 230 | 8.35 | 7.51 | 145 | 3.19 | 100 |

ADDITIONAL CHARACTERIZATION OF PRODUCT

| Run No. | DPF | Birefringence | Shrinkage | Work Loss | Stability Index | Tensile Index | Crystallinity | fa | fc |
|---|---|---|---|---|---|---|---|---|---|
| 1 | 2.1 | +.1815 | 5.6 | 0.0040 | 44.6 | 1245 | 45.8 | 0.562 | 0.970 |
| 2 | 2.1 | +.1785 | 5.0 | 0.0122 | 16.4 | 1289 | 46.2 | 0.536 | 0.976 |
| 3 | 2.2 | +.1827 | 5.8 | 0.0140 | 12.3 | 1235 | 48.0 | 0.557 | 0.976 |
| 4 | 2.2 | +.1823 | 4.8 | 0.0114 | 18.3 | 1221 | 49.4 | 0.545 | 0.979 |
| 5 | 2.2 | +.1819 | 5.4 | 0.0140 | 13.2 | 1211 | 50.8 | 0.538 | 0.976 |

Crystallinity = crystallinity expressed in percent
fa = amorphous orientation function
fc = crystalline orientation function

EXAMPLE III

The spinneret 2 consisted of 20 holes, and the poly-

TABLE I

| Run | FIRST DRAW | | | | SUBSEQUENT THERMAL TREATMENT: SECOND DRAW | | | | | SUBSEQUENT THERMAL TREATMENT: FINAL PORTION OF THERMAL TREATMENT | | | | | | Drawn to % |
|---|---|---|---|---|---|---|---|---|---|---|---|---|---|---|---|---|
| No. | DR | TEN | E | IM | DR | DT | TEN | E | IM | DR | DT | TEN | E | IM | Total DR | Max. DR |
| 1 | 2.70 | 4.45 | 40.0 | 95.7 | 1.36 | 180 | 8.02 | 8.15 | 129 | 1.05 | 220 | 8.47 | 7.64 | 132 | 3.86 | 92 |
| 2 | 2.70 | 4.45 | 40.0 | 95.7 | 1.36 | 180 | 8.02 | 8.15 | 129 | 1.10 | 240 | 7.92 | 8.13 | 134 | 4.04 | 96 |
| 3 | 2.70 | 4.45 | 40.0 | 95.7 | 1.36 | 200 | 7.87 | 8.42 | 126 | 1.04 | 220 | 8.20 | 8.02 | 132 | 3.82 | 91 |
| 4 | 2.70 | 4.45 | 40.0 | 95.7 | 1.36 | 200 | 7.87 | 8.42 | 126 | 1.10 | 240 | 8.77 | 7.36 | 144 | 4.04 | 96 |
| 5 | 2.53 | 4.27 | 45.5 | 88.6 | 1.45 | 190 | 8.05 | 7.97 | 131 | 1.06 | 230 | 8.43 | 7.67 | 128 | 3.89 | 93 |

ADDITIONAL CHARACTERIZATION OF PRODUCT

| Run No. | DPF | Birefringence | Shrinkage | Work Loss | Stability Index | Tensile Index | Crystallinity | fa | fc |
|---|---|---|---|---|---|---|---|---|---|
| 1 | 3.1 | +.1866 | 7.8 | 0.0189 | 6.8 | 1118 | 48.4 | 0.580 | 0.979 |
| 2 | 3.1 | +.1780 | 5.5 | 0.0147 | 12.4 | 1061 | 48.7 | 0.522 | 0.974 |
| 3 | 3.1 | +.1816 | 7.2 | 0.0161 | 8.6 | 1082 | 48.6 | 0.522 | 0.970 |
| 4 | 3.0 | +.1887 | 6.0 | 0.0172 | 9.7 | 1263 | 47.7 | 0.598 | 0.979 |
| 5 | 3.1 | +.1862 | 6.4 | 0.0188 | 8.3 | 1079 | 48.6 | 0.577 | 0.979 |

EXAMPLE II

The spinneret 2 consisted of 20 holes, and the polyethylene terephthalate was at a temperature of about 312° C. when extruded. The polyester throughput through spinneret 2 was 12 grams per minute and the spinning pack pressure was 1900 psig.

The relatively high stress exerted upon the filamentary material at the exit end of the solidification zone 12 as measured at point 30 was 0.041 gram per denier. The as-spun filamentary material was wrapped about skewed rolls 26 and 28 at a rate of 1000 meters per minute, and at that point in the process exhibited a relatively high birefringence of $+20\times10^{-3}$, and a total denier of 108. The maximum draw ratio for the as-spun ethylene terephthalate was at a temperature of about 316° C. when extruded. The polyester throughput through spinneret 2 was 12 grams per minute and the spinning pack pressure was 1500 psig.

The relatively high stress exerted upon the filamentary material at the exit end of the solidification zone 12 as measured at point 30 was 0.058 gram per denier. The as-spun filamentary material was wrapped about skewed rolls 26 and 28 at a rate of 1150 meters per minute, and at that point in the process exhibited a relatively high birefringence of $+30\times10^{-3}$, and a total denier of 94. The maximum draw ratio for the as-spun filamentary material prior to entering the first draw zone was approximately 2.6:1.

Summarized in Table III which follows are additional process parameters and results achieved for a plurality of runs in accordance with the process of the present invention wherein the conditions of the (1) first draw, (2) second draw, and (3) final portion of the thermal treatment were varied through an adjustment of the relative speeds of skewed rolls 36 and 38, 82 and 84, 88 and 90, and 94 and 96, as well as the temperatures of hot shoes 86 and 92.

TABLE III

| Run | FIRST DRAW | | | | SUBSEQUENT THERMAL TREATMENT: SECOND DRAW | | | | | SUBSEQUENT THERMAL TREATMENT: FINAL PORTION OR THERMAL TREATMENT | | | | | | Drawn to % |
|---|---|---|---|---|---|---|---|---|---|---|---|---|---|---|---|---|
| No. | DR | TEN | E | IM | DR | DT | TEN | E | IM | DR | DT | TEN | E | IM | Total DR | Max. DR |
| 1 | 1.17 | 2.85 | 121 | 33 | 1.95 | 180 | 7.54 | 7.54 | 125 | 1.04 | 220 | 8.77 | 7.26 | 128 | 2.37 | 91 |
| 2 | 1.17 | 2.85 | 121 | 33 | 1.95 | 180 | 7.54 | 7.54 | 125 | 1.04 | 240 | 8.83 | 7.60 | 131 | 2.37 | 91 |
| 3 | 1.17 | 2.85 | 121 | 33 | 2.03 | 200 | 8.49 | 7.40 | 126 | 1.02 | 220 | 9.02 | 7.21 | 133 | 2.42 | 93 |
| 4 | 1.17 | 2.85 | 121 | 33 | 2.03 | 200 | 8.49 | 7.40 | 126 | 1.03 | 240 | 9.11 | 7.29 | 134 | 2.45 | 94 |
| 5 | 1.17 | 2.70 | 134 | 30 | 2.01 | 190 | 7.51 | 8.30 | 119 | 1.04 | 230 | 7.48 | 8.33 | 132 | 2.32 | 89 |

ADDITIONAL CHARACTERIZATION OF PRODUCT

| Run No. | DPF | Birefringence | Shrinkage | Work Loss | Stability Index | Tensile Index | Crystallinity | fa | fc |
|---|---|---|---|---|---|---|---|---|---|
| 1 | 2.0 | +.1632 | 5.5 | 0.0119 | 15.3 | 1122 | 48.2 | 0.417 | 0.979 |
| 2 | 2.0 | +.1625 | 4.2 | 0.0119 | 20.0 | 1157 | 51.4 | 0.385 | 0.981 |
| 3 | 2.0 | +.1643 | 5.6 | 0.0146 | 12.2 | 1200 | 47.5 | 0.428 | 0.981 |
| 4 | 2.0 | +.1707 | 4.9 | 0.0122 | 16.7 | 1221 | 48.1 | 0.485 | 0.978 |
| 5 | 2.1 | +.1643 | 5.0 | 0.0119 | 16.8 | 987 | 49.6 | 0.415 | 0.978 |

EXAMPLE IV

The spinneret 2 consisted of 34 holes, and the polyethylene terephthalate was at a temperature of about 325° C. when extruded. The polyester throughput through spinneret 2 was 13 grams per minute and the spinning pack pressure was 750 psig.

The relatively high stress exerted upon the filamentary material at the exit end of the solidification zone 12 as measured at point 30 was 0.076 gram per denier. The as-spun filamentary material was wrapped about skewed rolls 26 and 28 at a rate of 1300 meters per minute, and at that point in the process exhibited a relatively high birefringence of $+38\times10^{-3}$, and a total denier of 90. The maximum draw ratio for the as-spun filamentary material prior to entering the first draw zone was approximately 2.52:1.

Summarized in Table IV which follows are additional process parameters and results achieved in accordance with the process of the present invention.

COMPARATIVE EXAMPLES

It has been demonstrated that the improved polyester filaments formed by the process of the present invention do not result if segments of a commercially available high strength polyethylene terephthalate tire cord yarn are subjected to thermal after processing procedures (identified hereafter). The starting material for the tests was melt spun under conventional low stress conditions to form an as-spun filamentary material possessing a birefringence of about $+1\times10^{-3}$, was hot drawn to about 85 percent of its maximum draw ratio in a plurality of steps which were carried out in an in-line manner following melt spinning, and was relaxed about 6 percent. The thermal after processing to which the commercially available high strength tire cord yarn was subjected was carried out by passage of the yarn over a hot shoe (provided at various temperatures) while under a longitudinal tension (provided at various levels to produce the draw ratios indicated). Identified in Table V which follows are characteristics of the starting material, the temperature of the hot shoe employed during the thermal after processing, the draw ratio utilized in the thermal after processing, and the characteristics of the filamentary material following the thermal after processing. The terms and abbreviations utilized are as previously defined.

TABLE IV

| FIRST DRAW | | | | SUBSEQUENT THERMAL TREATMENT: SECOND DRAW | | | | | SUBSEQUENT THERMAL TREATMENT: FINAL PORTION OF THERMAL TREATMENT | | | | | | Drawn to % |
|---|---|---|---|---|---|---|---|---|---|---|---|---|---|---|---|
| DR | TEN | E | IM | DR | DT | TEN | E | IM | DR | DT | TEN | E | IM | Total DR | Max. DR |
| 1.75 | 4.14 | 33.8 | 79 | 1.35 | 190 | 7.94 | 7.13 | 128 | 1.07 | 230 | 8.76 | 6.75 | 131 | 2.52 | 100 |

ADDITIONAL CHARACTERIZATION OF PRODUCT

| DPF | Birefringence | Shrinkage | Work Loss | Stability Index | Tensile Index | Crystallinity | fa | fc |
|---|---|---|---|---|---|---|---|---|
| 1.1 | +.161 | 5.0 | 0.0142 | 14.1 | 1148 | 50.3 | 0.381 | 0.970 |

TABLE V

| | THERMAL AFTER PROCESSING | | (Comparative Examples) CHARACTERIZATION OF PRODUCT | | | | | | |
|---|---|---|---|---|---|---|---|---|---|
| No. | DR | DT | Birefringence | Shrinkage | Work Loss | TEN | IM | Stability Index | Tensile Index |
| Control | none | none | +.1892 | 11.4 | 0.081 | 8.3 | 110 | 1.1 | 913 |
| 1 | 1.1 | 220 | +.1889 | 13.6 | 0.072 | 8.3 | 126 | 1.0 | 1046 |
| 2 | 1.0 | 220 | +.1885 | 11.2 | 0.084 | 8.2 | 112 | 1.1 | 918 |
| 3 | 0.9 | 220 | +.1727 | 8.2 | 0.099 | 6.6 | 60 | 1.2 | 396 |
| 4 | 1.0 | 240 | +.1789 | 8.0 | 0.054 | 7.9 | 102 | 2.3 | 806 |
| 5 | 1.0 | 200 | +.1830 | 10.2 | 0.083 | 8.0 | 104 | 1.2 | 832 |
| 6 | 1.05 | 210 | +.1920 | 13.3 | 0.082 | 8.3 | 126 | 0.92 | 1046 |
| 7 | 1.05 | 230 | +.1900 | 12.5 | 0.077 | 8.6 | 130 | 1.0 | 1118 |
| 8 | 0.95 | 230 | +.1811 | 6.6 | 0.084 | 7.7 | 92 | 1.8 | 708 |
| 9 | 0.95 | 210 | +.1770 | 7.2 | 0.078 | 7.7 | 89 | 1.8 | 685 |

It further has been demonstrated that the improved polyester filaments formed by the process of the present invention do not result if a conventional process for the formation of a high strength tire cord yarn is terminated after the first draw step, and segments of the resulting filamentary material subsequently are subjected to various hot drawing procedures. The starting material for the tests was melt spun under conventional low stress conditions to form an as-spun filamentary material possessing a birefringence of about $+1\times10^{-3}$, was hot drawn at a draw ratio of 3.65:1 in a single step carried out in an in-line manner following melt spinning, and was collected. The subsequent hot drawing procedure was carried out by passing the yarn starting material over a hot shoe (provided at various temperatures) while under a longitudinal tension (provided at various levels to produce the draw ratios indicated). Identified in Table VI which follows are characteristics of the starting material, the temperature of the hot shoe employed during the subsequent hot drawing procedure, the draw ratio utilized during the subsequent hot drawing, and the characteristics of the filamentary material following the subsequent hot drawing. The terms and abbreviations utilized are as previously defined.

TABLE VI

| | SUBSEQUENT DRAW | | (Comparative Examples) CHARACTERIZATION OF PRODUCT | | | | | | |
|---|---|---|---|---|---|---|---|---|---|
| Run No. | DR | DT | Birefringence | Shrinkage | Work Loss | TEN | IM | Stability Index | Tensile Index |
| Control | none | none | +.1428 | 16 | — | 3.6 | 65 | — | 234 |
| 1 | 1.31 | 160 | +.1846 | 23 | 0.131 | 6.6 | 105 | 0.33 | 693 |
| 2 | 1.21 | 160 | +.1804 | 21 | 0.104 | 5.1 | 101 | 0.46 | 515 |
| 3 | 1.62 | 180 | +.1930 | 19.2 | 0.128 | 8.0 | 111 | 0.41 | 888 |
| 4 | 1.80 | 180 | +.1809 | 21.2 | 0.118 | 6.1 | 100 | 0.40 | 610 |
| 5 | 1.63 | 200 | +.1884 | 17.6 | 0.115 | 8.2 | 110 | 0.49 | 902 |
| 6 | 1.91 | 200 | +.1830 | 17.0 | 0.116 | 6.2 | 103 | 0.51 | 639 |
| 7 | 1.7 | 180 | +.1927 | 19.7 | 0.131 | 8.7 | 124 | 0.39 | 1079 |
| 8 | 1.8 | 220 | +.1945 | 13.5 | 0.085 | 8.6 | 118 | 1.1 | 1015 |
| 9 | 1.6 | 220 | +.1917 | 14.4 | 0.076 | 7.7 | 117 | 1.1 | 901 |
| 10 | 1.4 | 220 | +.1802 | 13.3 | 0.074 | 6.6 | 98 | 1.0 | 647 |

For further comparative examples see Example Nos. 1 through 13 of commonly assigned U.S. Ser. No. 400,864, filed Sept. 26, 1973, which are herein incorporated by reference. These examples illustrate the relative low tenacity, initial modulus, and tensile index values commonly achieved when practicing various polyethylene terephthalate fiber forming processes other than that presently claimed including other processes which employ relatively high stress spinning conditions.

Although the invention has been described with preferred embodiments, it is to be understood that variations and modifications may be resorted to as will be apparent to those skilled in the art. Such variations and modifications are to be considered within the purview and scope of the claims appended hereto.

We claim:

1. A process for the production of improved polyester filaments of high strength having an unusually stable internal structure which particularly are suited for use at elevated temperatures and exhibit a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn of said filaments normalized to that of a multifilament yarn of 1000 total denier consisting essentially of:

(a) extruding a molten melt-spinnable polyester which contains 85 to 100 mol percent polyethylene terephthalate and 0 to 15 mol percent of copolymerized ester units other than polyethylene terephthalate having an intrinsic viscosity of 0.5 to 2.0 deciliters per gram through a shaped extrusion orifice having a plurality of openings to form a molten filamentary material, (b) passing the resulting molten filamentary material in the direction of its length through a solidification zone having an entrance end and an exit end wherein said molten filamentary material is uniformly quenched and transformed into a solid filamentary material, (c) withdrawing said solid filamentary material from said solidification zone while under a substantial stress of 0.015 to 0.150 gram per denier measured immediately below the exit end of said solidification zone, (d) continuously conveying said resulting as-spun filamentary material from the exit end of said solidification zone to a first stress isolation device at a rate of 500 to 3000 meters per minute with said filamentary material as it enters said first stress isolation device exhibiting a relatively high birefringence of $+9\times10^{-3}$ to $+70\times10^{-3}$, (e) continuously conveying said resulting filamentary material from said first stress isolation device to a first draw zone, (f) continuously drawing said resulting filamentary material at a draw ratio of 1.01:1 to 3.0:1 while present in said first draw zone, and (g) subsequently thermally treating said previously drawn filamentary material while under a longitudinal tension and present at a temperature above that of said first draw zone to achieve at least 85 percent of the maximum draw ratio of said as-spun filamentary material and impart a tenacity of at least 7.5 grams per denier to the same, with at least the final portion of said thermal treatment being conducted at a temperature within the range from about 90° C. below the differential scanning calorimeter peak melting temperature of the same up to below the temperature at which filament coalescence occurs.

2. A process according to claim 1 wherein said melt-spinnable polyester is substantially all polyethylene terephthalate.

3. A process according to claim 1 wherein said polyester prior to said extrusion has an intrinsic viscosity of 0.8 to 2.0 deciliters per gram.

4. A process according to claim 1 wherein said solidification zone is provided with a gaseous atmosphere at a temperature of about 10° to 60° C.

5. A process according to claim 4 wherein said gaseous atmosphere of said solidification zone is air.

6. A process according to claim 1 wherein said solid filamentary material is withdrawn from said solidification zone while under a substantial stress of 0.015 to 0.1 gram per denier measured immediately below the exit end of said solidification zone.

7. A process according to claim 1 wherein said solid filamentary material enters said first stress isolation device at a rate of 1000 or 2000 meters per minute.

8. A process according to claim 1 wherein said solid filamentary material as it enters said first stress isolation device exhibits a birefringence of $+9\times10^{-3}$ to $+40\times10^{-3}$.

9. A process according to claim 1 wherein said as-spun filamentary material as it enters said first stress isolation device exhibits a birefringence of $+9\times10^{-3}$ to $+30\times10^{-3}$.

10. A process according to claim 1 wherein said resulting filamentary material is drawn at a draw ratio of about 1.4:1 to 3.0:1 while present in said first draw zone.

11. A process according to claim 1 wherein said filamentary material consists of about 6 to 600 filaments.

12. A process according to claim 1 wherein said thermal treatment of step (g) is carried out in a plurality of stages at successively elevated temperatures.

13. A process according to claim 1 wherein at least the final portion of said thermal treatment of step (g) is conducted at a temperature within the range from about 60° C. below the differential scanning calorimeter peak melting temperature of the filamentary material up to below the temperature at which filament coalescence occurs.

14. A process according to claim 1 wherein said filamentary material following said thermal treatment of step (g) has an average denier per filament of about 1 to 20.

15. A process for the production of improved polyester filaments of high strength having an unusually stable internal structure which particularly are suited for use at elevated temperatures and exhibit a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn of said filaments normalized to that of a multifilament yarn of 1000 total denier consisting essentially of:

(a) extruding a molten melt-spinnable polyester which contains 90 to 100 mol percent polyethylene terephthalate and 0 to 10 mol percent of copolymerized ester units other than polyethylene terephthalate having an intrinsic viscosity of about 0.8 to 1.0 deciliters per gram through a shaped extrusion orifice having a plurality of openings to form a molten filamentary material, (b) passing the resulting molten polyester filamentary material in the direction of its length through a solidification zone having an entrance end and an exit end provided with a gaseous atmosphere at a temperature below 80° C. wherein said molten filamentary material is uniformly quenched and transformed into a solid filamentary material, (c) withdrawing said solid filamentary material from said solidification zone while under a substantial stress of 0.015 to 0.1 gram per denier measured immediately below the exit end of said solidification zone, (d) continuously conveying said resulting as-spun filamentary material from the exit end of said solidification zone to a first stress isolation device at a rate of 500 to 3000 meters per minute with said filamentary material as it enters said first stress isolation device exhibiting a relatively high birefringence of about $+9\times10^{-3}$ to about $+40\times10^{-3}$, (e) continuously conveying said resulting filamentary material from said first stress isolation device to a first draw zone, (f) continuously drawing said resulting filamentary material while present in said first draw zone at a draw ratio of about 1.4:1 to 3.0:1, and (g) subsequently thermally treating said previously drawn filamentary material while under a longitudinal tension and present at a temperature above that of said first draw zone to achieve at least 90 percent of the maximum draw ratio of said as-spun filamentary material and impart an average single filament tenacity of at least 7.5 grams per denier to the same, with at least the final portion of said thermal treatment being conducted at a temperature within the range of about 220° to 250° C. in the absence of filament coalescence.

16. A process according to claim 15 wherein said melt-spinnable polyester is substantially all polyethylene terephthalate.

17. A process according to claim 16 wherein said polyester prior to said extrusion has an intrinsic viscosity of 0.85 to 1.0 deciliters per gram.

18. A process according to claim 16 wherein said molten melt-spinnable polyester is provided at a temperature of about 270° to 325° C. when extruded through said shaped orifice.

19. A process according to claim 15 wherein said solidification zone is provided with a gaseous atmosphere at a temperature of about 10° to 50° C.

20. A process according to claim 19 wherein said gaseous atmosphere of said solidification zone is air.

21. A process according to claim 15 wherein said solid filamentary material is withdrawn from said solidification zone while under a substantial stress of 0.015 to 0.06 gram per denier measured immediately below the exit end of said solidification zone.

22. A process according to claim 21 wherein said as-spun filamentary material as it enters said first stress isolation device exhibits a birefringence of $+9\times10^{-3}$ to $+30\times10^{-3}$.

23. A process according to claim 15 wherein said solid filamentary material enters said first stress isolation device at a rate of 1000 to 2000 meters per minute.

24. A process according to claim 15 wherein said resulting filamentary material is drawn at a draw ratio of about 1.7:1 to 3.0:1 while present in said first draw zone.

25. A process according to claim 15 wherein said thermal treatment of step (g) is carried out in a plurality of stages at successively elevated temperatures.

26. A process according to claim 15 wherein said filamentary material consists of about 20 to 400 filaments.

27. A process according to claim 15 wherein said filamentary material following said thermal treatment of step (g) has an average denier per filaments of about 1 to 20.

28. A process for the production of improved polyester filaments of high strength which particularly are suited for use at elevated temperatures and exhibit a work loss of 0.004 to 0.02 inch-pounds when cycled between a stress of 0.6 gram per denier and 0.05 gram per denier at 150° C. measured at a constant strain rate of 0.5 inch per minute on a 10 inch length of yarn of said filaments normalized to that of a multifilament yarn of 1000 total denier consisting essentially of:

(a) extruding molten polyethylene terephthalate having an intrinsic viscosity of about 0.9 to 0.95 deciliters per gram through a shaped extrusion orifice having a plurality of openings while at a temperature of about 280° to 320° C. to form a molten filamentary material, (b) passing the resulting molten polyethylene terephthalate material in the direction of its length through a solidification zone having an entrance end and an exit end provided with a gaseous atmosphere at a temperature of about 10° to 40° C. wherein said extruded polyethylene terephthalate material is uniformly quenched and transformed into a solid filamentary material, (c) withdrawing said solid filamentary material from said solidification zone while under a substantial stress of 0.015 to 0.06 gram per denier measured immediately below the exit end of said solidification zone, (d) continuously conveying said resulting as-spun filamentary material from the exit end of said solidification zone to a first stress isolation device at a rate of about 1000 to 2000 meters per minute with said filamentary material as it enters said first stress isolation device exhibiting a relatively high birefringence of $+9\times10^{-3}$ to $+30\times10^{-3}$, (e) continuously conveying said resulting filamentary material from said first stress isolation device to a first draw zone, (f) continuously drawing said resulting filamentary material while present in said first draw zone at a draw ratio of about 1.4:1 to 3.0:1, and (g) subsequently thermally treating said previously drawn filamentary material while under a longitudinal tension and present at a temperature above that of said first draw zone to achieve at least 90 percent of the maximum draw ratio of said as-spun filamentary material and impart an average single filament tenacity of at least 7.5 grams per denier to the same, with at least the final portion of said thermal treatment being conducted at a temperature within the range of about 220° to 250° C.

29. A process according to claim 28 wherein said resulting filamentary material is drawn at a draw ratio of about 1.7:1 to 3.0:1 while present in said first draw zone.

* * * * *